United States Patent [19]

Ward et al.

[11] 4,098,655

[45] Jul. 4, 1978

[54] METHOD FOR FABRICATING A PHOTORECEPTOR

[75] Inventors: Anthony T. Ward, Webster; Donald J. Teney, Rochester; James M. Ishler, Ontario, all of N.Y.; Aleksandar Damjanovic, Morristown, N.J.

[73] Assignee: Xerox Corporation, Stamford, Conn.

[21] Appl. No.: 836,125

[22] Filed: Sep. 23, 1977

[51] Int. Cl.[2] ..... G03G 5/05; C25D 11/34

[52] U.S. Cl. ..... 204/38 A; 427/76; 96/1.5 N

[58] Field of Search ..... 204/38 A; 427/76, 430, 427/435; 96/1.5, 1.5 C

[56] References Cited

U.S. PATENT DOCUMENTS

| | | | |
|---|---|---|---|
| 3,174,855 | 3/1965 | Gray | 96/1.5 |
| 3,725,058 | 4/1973 | Hayashi et al. | 96/1.5 |
| 3,907,650 | 9/1975 | Pinsler | 204/34 |

*Primary Examiner*—John H. Mack
*Assistant Examiner*—William T. Leader
*Attorney, Agent, or Firm*—James J. Ralabate; James P. O'Sullivan; Gaetano D. Maccarone

[57] ABSTRACT

There is described a method for forming a photoreceptor wherein a substrate having a thin electrically insulating oxide film on a surface thereof is subjected to an electroless deposition step from a selenious acid solution whereby the oxide film is dissolved and a thin selenium layer is formed on the substrate. In one embodiment, a relatively thick photoconductive insulating layer comprising selenium or alloys thereof is deposited by vacuum evaporation over the previously electrolessly deposited selenium layer. In another embodiment, a layer of a charge carrier transport material is deposited over the selenium layer. In a preferred embodiment of the invention, an oxide-free substrate is initially subjected to an electrochemical oxidation step in an alkaline medium to form a thin electrically insulating oxide film on the surface thereof.

10 Claims, No Drawings

METHOD FOR FABRICATING A PHOTORECEPTOR

BACKGROUND OF THE INVENTION

This invention is directed to a method for fabricating an electrophotographic photoreceptor and, more particularly, to such a method wherein a thin selenium layer is deposited on a substrate by electroless deposition.

The formation and development of images on the imaging surfaces of photoconductive materials by electrostatic means is well known. The best known of the commercial processes, more commonly known as xerography, involves forming an electrostatic latent image on the imaging surface of a photoreceptor by first uniformly electrostatically charging the surface of the imaging layer in the dark and then exposing this electrostatically charged surface to an imagewise pattern of activating electromagnetic radiation. The light-struck areas of the imaging layer are thus rendered relatively conductive and the electrostatic charge selectively dissipated in these irradiated areas. After the photoreceptor is exposed, the electrostatic latent image on this image bearing surface is typically rendered visible with a finely divided colored marking material, known in the art as "toner". This toner will be principally attracted to those areas on the image bearing surface which retain the electrostatic charge and thus form a visible powder image. The electrostatic latent image may also be used in a host of other ways as, for example, electrostatic scanning systems may be employed to "read" the latent image or the latent image may be transferred to other materials by TESI techniques and stored. A developed image can then be read or permanently affixed to the photoconductor where the imaging layer is not to be reused.

in the commercial "plain paper" copying systems, the latent image is typically developed on the surface of a reusable photoreceptor, subsequently transferred to a sheet of paper and then permanently affixed thereto to form a permanent reproduction of the original object. The imaging surface of the photoreceptor is then cleaned of any residual toner and additional reproductions of the same or other original objects can be made thereon.

Many techniques for fabricating photoreceptors are known in the art. Nevertheless, even in well established areas of technology such as xerography there continue to be found novel techniques for fabricating known articles. The present invention relates to a novel method for fabricating a photoreceptor.

SUMMARY OF THE INVENTION

It is therefore the object of this invention to provide a method for fabricating a photoreceptor.

It is another object to provide such a method wherein a thin selenium layer is formed on a substate by electroless deposition.

It is a further object to provide such a method wherein the substrate is an endless flexible belt.

Still another object is to provide such a method wherein a layer of selenium or its alloys is vacuum deposited over the thin selenium layer formed by electroless deposition.

Yet another object is to provide such a method wherein a layer of a charge carrier transport material is deposited over the thin selenium layer formed by electroless deposition.

BRIEF SUMMARY OF THE INVENTION

These and other objects and advantages are accomplished in accordance with the invention by providing a method for fabricating a photoreceptor wherein a substrate having a thin electrically insulating oxide film on a surface thereof is subjected to an electroless deposition step from a selenious acid solution whereby the oxide film is dissolved and a thin selenium layer is formed on the substrate. In a preferred embodiment of the invention, an oxide-free substrate is initially subjected to an electromechanical oxidation step in an alkaline medium to form a thin electrically insulating oxide film on the surface thereof.

In one embodiment of the invention, a relatively thick photoconductive insulating layer comprising selenium or its alloys is vacuum deposited over the previously formed thin selenium layer. In another embodiment, a layer of a charge carrier transport material capable of transporting at least one species of charge carrier is deposited over the thin selenium layer.

DESCRIPTION OF THE PREFERRED EMBODIMENTS

The substrate may comprise any metal less positive than selenium in the electrochemical series and must have a surface oxide film. The signal convention used herein to identify the position of elements in the electrochemical convention is that defined by the 1953 Stockholm Convention. The surface oxide film may be provided either by electrochemical oxidation which will be described in detail below or by air oxidation, e.g., by heating the metal in air or merely allowing the metal to stand in air for a sufficient period of time. Zinc, cadmium and aluminum are suitable substrate materials since they are less positive than selenium in the electrochemical series and form surface oxides readily on standing in air. Nickel is a preferred substrate material because of its physical, electrical, electrochemical and mechanical properties. Typical suitable nickel substrates include those electroformed with carbonyl process nickel anodes and those electroformed with sulfur depolarized nickel (about 3% by weight cobalt) anodes. Preferably the required surface oxide film is formed on nickel substrates by electrochemical oxidation since this metal readily undergoes this reaction. The substrate may be a single layer of a metal having the requisite characteristics or it may be a layer of a suitable metal residing on a supporting layer which may itself be a different suitable metal or a metal which of itself would not be suitable as a substrate material for selenium. The substrate may be of any thickness which is satisfactory for use in electrophotographic photoreceptors, may be rigid or flexible and can be provided in any suitable form such as, for example, a sheet, web, cylinder, endless belt or the like. A preferred substrate according to the invention is an endless flexible, seamless belt which comprises nickel.

The surface oxide film present on the substrate should be of substantially uniform thickness, substantially nonporous and electrically insulating. As described above, the surface oxide layer can be provided by air oxidation or electrochemical oxidation. Where the surface oxide film is formed by electrochemical oxidation, such as is preferred for nickel substrates, the oxide film having the requisite characteristics can be achieved by making the substrate the anode of an electrochemical cell which contains an aqueous solution containing hydroxyl ions ($OH^-$). The cathode of the cell may be the same metal as the substrate or it may be any other metal which is not chemically dissolved in the electrolyte. Typical suitable electrolytes include, for example, dilute aqueous alkali solutions such as 0.1M potassium hydroxide or 0.1M sodium hydroxide. The choice of electrolyte concentration is not particularly critical. Dilute solutions, i.e., less than about 1M, are preferred because subsequent rinsing requirements are appropriately reduced. Very dilute solutions, i.e., less than about $10^{-3}$M, should be avoided, however, in order to prevent substantial resistance losses in the electrolyte in high current density situations. Accordingly, the preferred electrolyte concentration range is from about $10^{-3}$M to about 1M. The electrochemical cell configurations for carrying out this step are well known in the art and thus a description of such a cell is not required here.

For the case of nickel substrates subjected to electrochemical oxidation, the passage through the electrolyte of an anodic pulse having a current between about $10^{-4}$ A/cm$^2$ and about $10^{-1}$ A/cm$^2$ of anode surface area supplied by a D.C. power supply will cause the nickel anode surface to undergo the initial reaction:

$$Ni + 2OH^- \rightarrow 2e^- + NI(OH)_2 \quad (1)$$

The thickness of the oxide film can be estimated as a function of the time of deposition from the quantity of charge passed through the electrolyte in (1) since practically no other charge consuming reactions occur during the initial film growth period (when the electrode potential is still below about 1.3 V versus a hydrogen reference electrode). Above about 1.3 V (H.E.) some charge is consumed by oxygen evolution. For nickel substrates typically the oxide film grows to a thickness between about 50 A and 75 A in about 12 minutes at a current density of $10^{-4}$ A/cm$^2$ and in about 1 second at a current density of $10^{-1}$ A/cm$^2$.

In addition to forming a surface oxide layer on the substrate, the anodic oxidation step provides the additional function of cleaning the substrate surface of any organic impurities which may be present. The anodic oxidation step is normally carried out at room temperature. However, the electrochemical processes which occur during anodic oxidation appear to be substantially similar at electrolyte temperatures up to about 70° C so that the process can be conducted at elevated temperatures if so desired.

For nickel substrates the thickness of the nickel oxide film formed by the application of a single anodic pulse of 60 millicoulombs/cm$^2$ can range from about 50 to about 75 angstroms. The oxide layer does not continue to grow above this thickness with any significant rate if the substrate is left in the electrolyte. For very pure nickel substrates, e.g. those electroformed with carbonyl process nickel electrodes, it is preferred to employ one anodic pulse only. The nickel oxide film formed on the substrate has the desired properties of thickness uniformity, porosity and electrical insulation for use in the subsequent electroless deposition step.

It should be noted that a complication may arise if the passage of current occurs for times longer than is required for the initial growth of 50 A - 70 A of nickel oxide. Further oxidation of the nickel oxide film occurs according to:

$$Ni(OH)_2 + OH^- + e^- \rightarrow NiO(OH) + H_2O \quad (2)$$

In situ ellipsometric studies of the oxidation reaction on smooth nickel indicate a chemical interconversion of $Ni(OH)_2$ and NiO(OH). During this interconversion, the film no longer grows by a simple high field assisted ionic diffusion mechanism. When oxidation to NiO(OH) is complete, further growth stops because the NiO(OH) film is electrically conductive. However, reaction (2) may be reversed by reversing the direction of current flow in the electrochemical cell. Ellipsometric studies verify that $Ni(OH)_2$ is restored during this process. Additional 15 A - 20 A increments in the nickel oxide film thickness can be achieved by successive oxidation to Nio(OH) according to reaction (2) and reduction back to $Ni(OH)_2$ by reversing the cell current. The use of multiple anodic and cathodic pulses for film growth provides thicker nickel oxide layers than are possible with only a single anodic pulse and also has the added advantage of cleaning the surface of the substrate by oxidation, reduction or desorption of any organic impurities. For nickel substrates electroformed with sulfur depolarized nickel anodes, it is preferred to use the thicker oxide film resulting from the multiple anodic/-cathodic pulse technique. Nickel substrates of this type typically exhibit higher electrochemical activity, i.e., a higher tendency to dissolve in acid media, than the more pure nickel substrates obtained by electroforming with carbonyl process nickel anodes, and it is theorized that the former require thicker oxide films for proper moderation of the nickel dissolution which occurs in the subsequent electroless deposition step. Subsequent to the electrochemical oxidation step the substrate is removed from the electrolyte and rinsed thoroughly with distilled water.

Electroless deposition of a thin selenium layer on the substrate is carried out in a vessel filled with an aqueous selenious acid electrolyte in the absence of applied electrical potential. The metal oxide film is dissolved by the selenious acid solution and is etched away in a highly localized manner to give deep "pits" which extend to the substrate metal. The exposed metal areas reduce the ions of more noble elements, i.e. selenium, present in the electrolyte. In the case of nickel substrates, the process of nickel oxide dissolution and electrochemical displacement of selenium by nickel proceeds according to the following reactions:

$$Ni \rightarrow Ni^{2+} + 2e^- \quad (3)$$

$$H_2SeO_3 + 4H^+ + 4e^- \rightarrow Se + 3H_2O \quad (4)$$

The electrons required to reduce selenious acid to selenium in (4) are supplied by dissolution of substrate nickel as $Ni^{2+}$ in (3). Such a process is normally self-limiting insofar as the substrate nickel rapidly becomes covered with a few monolayers of selenium and further reaction ceases. However, here the presence of nickel oxide on the surface provides an alternative pathway for the oxidation and escape of the substrate nickel atoms according to (3). The $Ni^{++}$ ions from (3) migrate through the oxide film to the electrolyte boundary. As long as this pathway is available for (3) to occur, selenium will continue to deposit on the nickel substrate via (4). The two reactions form a "local galvanic cell" with the selenium initially deposited acting as the cathode and the nickel oxide as the anode. This "cell" drives the deposition of selenium and the oxidation of nickel. No external supply of electrons is required and therefore the term "electroless deposition" can be applied to the process. Electroless deposition eventually ceases because the oxide film is ultimately consumed by chemical dissolution. As a consequence of the electroless deposition mechanism, the selenium film is deposited directly on the nickel substrate substantially without any intervening nickel oxide. Although the mechanism for the electroless deposition of selenium according to the invention has been discussed with respect to nickel, it will be understood that it is also applicable to the other metals which are suitable for use as substrate materials.

A typical electrolyte for the electroless deposition is made up of aqueous selenious acid having a concentration between about $10^{-2}$M and about 10M. The preferred concentration is about 0.1M at which point the electrolyte has a pH at room temperature of about 2.1. The bath is typically maintained at a temperature between about 70° C and about 100° C and preferably between about 90° C and about 100° C. Under these preferred conditions immersion of an electrochemically oxidized nickel substrate in the bath will typically result in dissolution of the nickel oxide film on the nickel surface and electroless deposition of a selenium film in less than two minutes. Lowering the concentration of the electrolyte to $10^{-2}$M or lowering the bath temperature to between about 70° C and 80° C, or deliberate reduction of bath acidity (e.g., deliberately increasing the bath pH from 2.1 to 5.0) by addition of alkali (e.g., potassium hydroxide) will typically increase the time required for electroless deposition of the selenium film by up to 10 minutes. Deliberately increasing the bath acidity (e.g., by decreasing bath pH from 2.1 to 1.0) by addition of acid (e.g., sulfuric acid) results in faster deposition time but also causes redissolution of the selenium film. The thickness of the selenium film formed according to the electroless deposition step is in the range of from about 1000 to about 3000 A.

The selenium film formed according to the foregoing process may be amorphous, trigonal (or crystalline) or a mixture of the two forms. Analysis of interfacial selenium films formed in this manner by scanning electron microscopy and reflective high energy electron diffraction indicate the degree of crystallinity of the selenium film depends on the time for which it resides in the bath. Studies have shown that the selenium film undergoes in situ thermal conversion from a partially amorphous to a substantially crystalline state for electroless deposition times greater than about two minutes at 90° C to 100° C. In addition selenium layers obtained by electroless deposition for about two minutes or less at 90° C to 100° C exhibit a photoconductivity spectral response typical of amorphous selenium whereas those obtained by electroless deposition for about five minutes or more exhibit a photoconductivity spectral response typical of trigonal, or crystalline, selenium. Where the photoreceptor being formed is flexible and intended for use in relatively high speed applications, it is preferred to have amorphous selenium in the interfacial layer because it has slightly better mechanical properties.

As discussed above, air-oxidized metals such as zinc, cadmium and aluminum readily undergo electroless deposition of selenium from aqueous selenious acid. Conditions identical to those described above for electrochemically oxidized nickel substrates will provide excellent deposition results for air-oxidized zinc, cadmium and aluminum. Again, the selenium deposit may be amorphous or crystalline depending on the time and temperature of the deposition. However, since zinc, cadmium and aluminum are much higher in the electrochemical series than nickel, they are more active electrochemically and can cause deposition of selenium to occur even at room temperature. At room temperature the product of electroless deposition is always amorphous selenium. It will be understood by those skilled in the art that the mechanical properties of zinc, cadmium and aluminum typically make these metals less desirable for use than nickel in applications requiring high tensile strength for the photoreceptor as where it is an endless flexible belt designed for use at high speed. However, where high tensile strength is not required as where the photoreceptor is in the form of a rigid drum, a drum-mounted sleeve or a flat plate, these metals are more desirable.

After the electroless deposition step the selenium-coated metal substrate is removed from the bath, rinsed well and dried thoroughly. The member is then ready for the formation of the remaining layers of the photoreceptor.

In one embodiment a relatively thick photoconductive layer comprising selenium or its alloys is vacuum evaporated over the thin selenium layer previously formed. The photoconductive insulating layer typically has a thickness between about 10 and about 60 microns. In another embodiment there is deposited over the thin selenium layer a layer of a charge carrier transport material which is capable of transporting at least one species of charge carrier. This can be done by any suitable method such as, for example, by dip coating from a solution of the transport material or by a draw bat coating technique. The charge carrier transport material layer typically has a thickness of from about 3 to about 20 microns. Any suitable charge carrier transport material may be used. Typical suitable transport materials include, for example, poly(N-vinylcarbazole), poly(vinylpyrene), poly(vinylnaphthalene), poly(2-vinylanthracene) and poly(9-vinylanthracene). A charge carrier transport matrix may also be formed by combining one or more electronically inert polymers such as poly(vinylchloride) with one or more of the above-named transport materials. The method of combination of such electronically distinct polymers can include copolymerization (random, graft, block, etc.,), formation of an interpenetrating polymer network and polymer blending. Alternatively an electronically inert polymer matrix can be rendered an efficient transporter of charge carriers by the incorporation within a film of such materials so-called "small molecules" capable of an efficient carrier transport. The term "small molecules" is inclusive of single molecules and low molecular weight polymers. These small molecules can be added to the casting or coating solution during formation of the polymeric matrix or can be subsequently introduced into the matrix by swelling of the polymeric materials of the matrix with a solution containing the small molecule compounds. Upon evaporation of the liquid phase of the solution, the small molecules will remain entrapped within the polymeric matrix thus enhancing charge carrier transport properties of this insulating film. These small molecules can also be added to active polymeric matrices in order to enhance the transport of charge carriers not readily transported by the electronically active polymer. For example, Lewis Acid can be added to a photoconductive polymer such as poly(N-vinylcarbazole) in order to improve electron transport. Representative of small molecule additives, which can be added to either an electronically active or inert polymer matrix to facilitate hole (+) transport include pyrene, anthracene, carbazole, triphenylamine, naphthalene, julolidine, indole and perylene. Small molecule additives, which can be incorporated into either an electronically active or inert polymer matrix to facilitate electron (−) transport include anthracene, fluorenone, 9-dicyanomethylene-fluorene, the nitro derivatives of fluorenone, the nitro derivatives of 9-dicyanomethylene-fluorene and chloranil. Both hole and electron small molecule transport materials can be used in combination with one another in inert polymers. A number of the above small molecules are known to form charge transfer complexes with both the inert and active polymer systems and some absorption by the matrix complex is permitted provided that the absorptivity of the resulting charge transfer complex does not compete with the selenium layer since it is desired that the selenium layer be the primary source of photogenerated charge carriers for the photoreceptor in the imaging method. Hence, the charge carrier transport layer is preferably substantially non-photosensitive to the radiation employed to expose the photoreceptor during imaging which is typically visible light. When nickel is the substrate material, it is preferred to employ an electron transport material for the charge carrier transport layer in order to take advantage of the excellent electron blocking characteristics of the nickel-selenium contact. When aluminum is the substrate material, either electron or hole transport materials can be employed for the charge carrier transport layer.

The photoreceptors fabricated according to the method of the invention can be utilized to form reproductions of original objects according to well known electrophotographic imaging methods. Generally, the photoreceptor is electrostatically charged, exposed to an imagewise pattern of activating electromagentic radiation to form an electrostatic latent image and then contacted with a developer material to form a visible image which is typically transferred to a permanent receiver member and fixed thereto. The photoreceptor may then be cleaned to remove any residual developer material and used to form additional reproductions.

The invention will now be further described in detail with respect to specific preferred embodiments by way of Examples, it being understood that these are intended to be illustrative only and the invention is not limited to the materials, conditions, process parameters, etc., recited therein. All percentages recited are by weight unless otherwise specified.

EXAMPLE I

The substrate of interest was an approximately 4 inch × 4 inch × 0.005 inch section of nickel sheet electroformed by the sulfur depolarized nickel anode process. This substrate was made one electrode of an electrochemical cell comprising a large open beaker containing 3 liters of 0.1M aqueous sodium hydroxide solution. A similar piece of nickel sheet was made the counter electrode. A D.C. pulse of 2.5 milliampers/cm$^2$ was applied first for 30 seconds with the substrate of interest as the cathode. Then the current direction was reversed so the substrate of interest was the anode of the cell and a pulse applied for 30 seconds. Reversal of the current direction was repeated subsequently at 30 second intervals until a total of 4 cathodic/anodic cycles and a final cathodic pulse were applied. The substrate of interest was then removed from the cell and rinsed thoroughly in a stream of deionized water.

The electrochemically oxidized substrate was then placed in an electroless deposition bath which was made up of an open beaker containing 1 liter of 0.1M aqueous selenious acid maintained at a temperature of 95° C. After being immersed for about 2 minutes the substrate was removed from the bath, rinsed thoroughly with a stream of deionzied water and then allowed to dry in air for several hours.

The dried substrate was then mounted in a bell jar vacuum evaporator and a layer of a halogenated seleniumarsenic alloy was deposited thereon by conventional vapor deposition techniques to a thickness of about 60 microns. The substrate temperature was maintained at about 55° C during deposition.

The resulting photoreceptor was found to survive being flexed around a 2 inch diameter cylindrical mandrel indicating excellent adhesion between the vacuum deposited selenium alloy layer and the nickel substrate.

The photoreceptor was then used to make reproductions of an original object using a Xerox Model D Processor. Excellent quality reproductions were obtained.

EXAMPLE II

The procedure of Example I was repeated with the exception that the substrate of interest was a 4 inch × 4 inch × 0.005 inch section of nickel sheet electroformed by the carbonyl nickel anode process and only one D.C. pulse of 2.5 milliamperes/cm$^2$ for 30 seconds was applied with the substrate as the anode of the electrochemical oxidation cell. The photoreceptor exhibited the same excellent adhesion and xerographic imaging properties.

EXAMPLE III

The procedure of Example I was repeated with the exception that after electroless deposition of the thin selenium layer and rinsing and drying an approximately 5 micron thick charge carrier transport layer of 50% by weight 2,4,7-trinitro-9-fluorenone (TNF) and 50% by weight of Flexclad, polyester resin (available from Goodyear) was deposited over the thin selenium layer. The transport layer was deposited by draw bar coating techniques from a solution in tetrahydrofuran. The photoreceptor was dried in vacuo at 40° C for about 48 hours to remove excess solvent.

The photoreceptor was evaluated xerographically in a conventional moving table xerographic discharge apparatus. The results showed excellent positive charge acceptance, very low dark decay and photosensitivity comparable to that of a conventional amorphous selenium photoreceptor.

EXAMPLE IV

The substrate of interest was a brush-grained aluminum sheet (available from Richardson Graphics Co., Holyoke, Mass.) which was used as received without any oxidative treatment beyond that experienced by the substrate due to standing in the ambient environment. The sheet was immersed for several hours in a 0.1M aqueous selenious acid solution at room temperature. The color of the sheet changed from light grey to reddish-brown due to electroless deposition of a finely divided deposit of amorphous selenium. The sheet was removed from the acid solution, rinsed with a stream of deionized water and dried in vacuo at room temperature.

The selenium layer was then overcoated with an approximately 15 micron thick layer of Makrolon (a polycarbonate available from Bayer Chemical) containing about 40% by weight of triphenylmethane. The coating was carried out by conventional draw bar techniques from a solution in tetrahydrofuran.

The photoreceptor was evaluated with a conventional moving table xerographic discharge apparatus. Results showed excellent negative charge acceptance, low dark decay and photosensitivity comparable to conventional amorphous selenium photoreceptors.

Although the invention has been described with respect to specific preferred embodiments, it is not intended to be limited thereto but rather those skilled in the art will recognize that variations and modifications may be made which are within the spirit of the invention and the scope of the claims.

What is claimed is:

1. A method for fabricating a photoreceptor comprising (a) providing a substrate comprising a metal which is less positive than selenium in the electrochemical series, said substrate having a thin layer of an oxide of said metal on at least one surface thereof;

(b) contacting said metal oxide layer with an aqueous selenious acid solution in the absence of applied electrical potential whereby said metal oxide is dissolved and a thin layer of selenium is formed on said surface of said substrate by electrochemical displacement; and (c) vacuum evaporating a photoconductive layer comprising selenium or its alloys over said thin selenium layer formed in step (b).

2. The method as defined in claim 1 wherein said substrate comprises a metal selected from the group consisting of zinc, cadmium, aluminum and nickel.

3. The method as defined in claim 1 wherein said substrate comprises nickel and is an endless flexible belt and wherein step (a) includes forming a layer of nickel oxide on a surface of the nickel substrate by electrochemical oxidation from an alkaline medium.

4. The method as defined in claim 1 wherein said layer of selenium formed in step (b) has an average thickness of from about 1000 to about 3000 angstroms.

5. A method for fabricating a photoreceptor comprising (a) providing a substrate comprising a metal which is less positive than selenium in the electrochemical series, said substrate having a thin layer of an oxide of said metal on at least one surface thereof;

(b) contacting said metal oxide layer with an aqueous selenious acid solution in the absence of applied electrical potential whereby said metal oxide is dissolved and a thin layer of selenium is formed on said surface of said substrate by electrochemical displacement; and (c) depositing over said thin selenium layer a layer of a charge carrier transport material capable of transporting at least one species of charge carrier.

6. The method as defined in claim 5 wherein said substrate comprises a metal selected from the group consisting of zinc, cadmium, aluminum and nickel.

7. The method as defined in claim 5 wherein said charge carrier transport material is an electron transport material.

8. The method as defined in claim 5 wherein said substrate comprises nickel and is an endless flexible belt and wherein step (a) includes forming a layer of nickel oxide on a surface of said substrate by electrochemical oxidation.

9. The method as defined in claim 5 wherein said layer of selenium formed in step (b) has an average thickness of from about 1000 to about 3000 angstroms.

10. The method as defined in claim 5 wherein said selenium layer formed in step (b) is crystalline.

* * * * *